United States Patent [19]

Psyras

[11] 4,132,031

[45] Jan. 2, 1979

[54] AERODYNAMIC TOY WITH RADIAL ELEVATIONS ON ITS CONVEX SIDE

[76] Inventor: Louis G. Psyras, 295 Commonwealth Ave., Boston, Mass. 02116

[21] Appl. No.: 793,923

[22] Filed: May 5, 1977

[51] Int. Cl.[2] ..... A63H 33/26; A63H 1/32

[52] U.S. Cl. ..... 46/228; 46/74 D

[58] Field of Search ..... 46/74 D, 227, 228, 229; 273/106 B; D34/15 HS

[56] References Cited

U.S. PATENT DOCUMENTS

| | | | |
|---|---|---|---|
| D. 208,334 | 8/1967 | Gerds | D34/15 HS |
| 3,185,480 | 5/1965 | Weyman et al. | 273/106 B |
| 3,613,295 | 10/1971 | Everett | 273/106 B X |
| 3,720,018 | 3/1973 | Peterson et al. | 46/228 |
| 3,786,246 | 1/1974 | Johnson et al. | 46/74 D |
| 3,948,523 | 4/1976 | Michael | 46/74 D X |
| 3,958,918 | 6/1976 | Ortiz | 46/74 D X |

*Primary Examiner*—F. Barry Shay

*Attorney, Agent, or Firm*—Herbert L. Gatewood

[57] ABSTRACT

An aerodynamic toy is provided for use in throwing games. The toy is shaped somewhat like a saucer and its body is provided on its convex sides with radial elevations. These provide discontinuities to the flow of air so that in use the air flow over the convex surface of the aerodynamic toy is disrupted thereby creating a turbulent air layer over the moving surface and reducing aerodynamic drag. An openable central compartment on the concave side may be used to contain batteries and a switch to power lights. The latter are supported by clips near the rim of the saucer.

14 Claims, 8 Drawing Figures

AERODYNAMIC TOY WITH RADIAL ELEVATIONS ON ITS CONVEX SIDE

BACKGROUND OF THE INVENTION (1) Field of the Invention

This invention relates to an aerodynamic toy of novel configuration to be thrown by hand through the air.

(2) Discription of the Prior Art

Aerodynamic toys resembling so-called "flying saucers", and which are thrown by hand through the air, have gained increased popularity over the past several years. Throwing is accomplished with a wrist snapping action wherein a spinning motion is imparted to the toy and it flies through the air. The direction of flight from the thrower in general depends upon the thrower's skill, and the type of flight path (e.g. curved or straight) depends upon the angle of the toy saucer in relation to the ground when it is released by the thrower.

It is believed that the saucer or aerodynamic toy flies as it does, i.e., when released approximately horizontal to the ground, because it approximates an air foil. Hence its' flight through the air is enhanced by aerodynamic lift.

Various toys of this type have been developed and have been enjoyed by the young, and the not-so-young, in backyards, on playgrounds, at the seashore, and other recreational areas. Examplary of the prior art patents showing various of these aerodynamic toys are U.S. Pat. Nos. 2,659,178; D183,626; 2,835,073; 3,359,678; 3,566,532; 3,710,505; 3,828,466; 3,498,523; and 3,959,916.

While at least one of the aerodynamic toys heretofore available commercially has achieved a wide measure of popularity, and is quite satisfactory in its performance, others have not been so popular. Some of these aerodynamic toys have provided relatively poor performance because they just don't have sufficient stability in flight and aerodynamic lift as they are too heavy, or are too light, or of less suitable configuration, or the like.

SUMMARY OF THE INVENTION

In accordance with the general aspects of the invention disclosed herein there is provided an aerodynamic toy comprising a rotatable free flight body of generally circular configuration having a convex upper surface and a concave bottom surface comprising a geometrically centrally disposed cylindrical shaped first body portion of predetermined length and having an upper end and a lower end, a flat surface integral with and closing the cylindrical body portion at said upper end, a second body portion concentric with the first body portion having a generally convex and concave side integral with and extending outwardly from the cylindrical body portion at the said open end, a rim portion integral with and defining the circumferential perimeter of the convex surface, said rim portion having a shape approximating that of a parabola and opening toward the center of the aerodynamic toy, and a plurality of elevations extending radially outwardly from the first body portion and being integral with the said second body portion. These elevations serve to interrupt the smooth flow of air during use of the toy over its convex side. In aerodynamics this action is referred to as "spoiling" the air flow and the means by which this is accomplished are often referred to as "spoilers".

As applied to the present invention, the elevations are believed to create a turbulent unseparated boundary layer over the convex side of the aerodynamic toy thereby resulting in a reduction of drag, especially in high-speed flight, and an increase in stability while in flight.

Moreover, it is believed, that the elevations create a more rapid flow of air over their curved surface compared to the flow of air over the flat surfaces between the elevation and result in improved lift.

In a preferred aspect of the invention, four elevations are provided equidistantly angularly around the circumferance of the aerodynamic toy, each elevation being of greater width nearer the geometric center of the aerodynamic toy than at its outer perimeter. Quite advantageously, as above mentioned, these elevations provide discontinuities to the flow of air across the aerodynamic toy and result in improved lift during flight.

In a still further, but optional aspect of the invention, lighting means are provided in combination with the aerodynamic toy. Thus, when the aerodynamic toy is used in darkness it not only will produce a light of circular motion but can be more easily followed and located, if desired.

BRIEF DESCRIPTION OF THE DRAWINGS

The invention will be better understood by referring to the drawings in which like numerals refer to like part in the various views, and in which.

DETAILED DESCRIPTION OF THE INVENTION AND THE PREFERRED EMBODIMENTS

Figure 1:
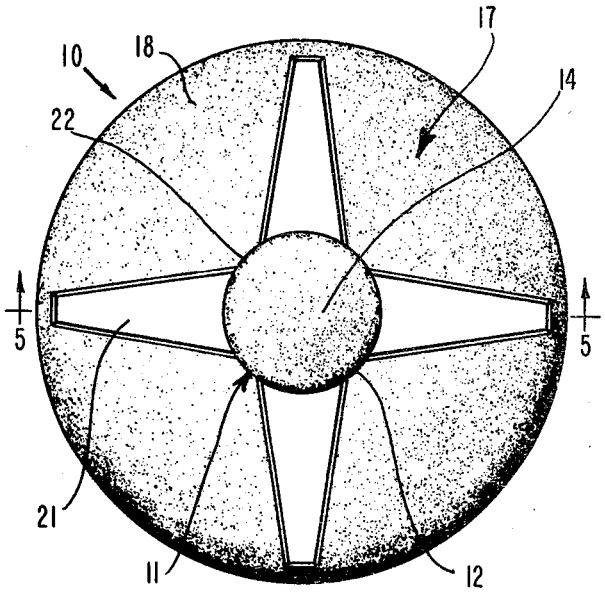
FIG. 1 is a plan view of the convex side of an aerodynamic toy in accordance with the invention.
Figure 2:
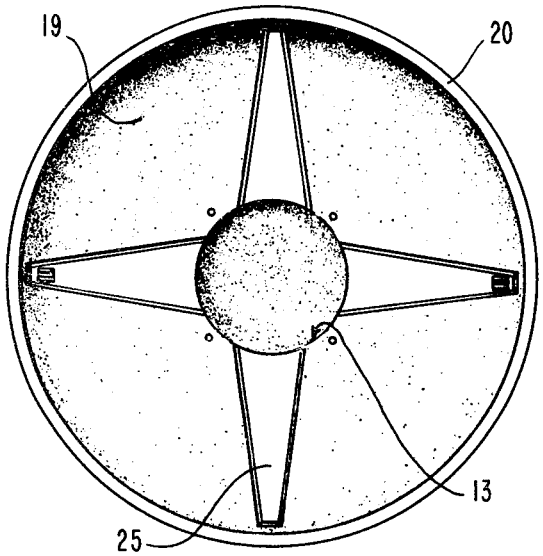
FIG. 2 is a plan view of the concave or underneath side of the aerodynamic toy shown in FIG. 1.
Figure 3:
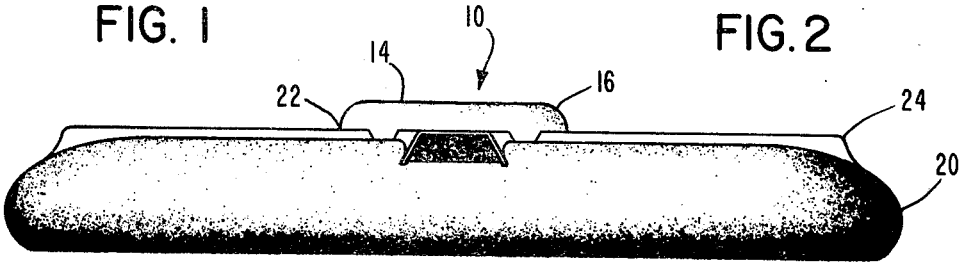
FIG. 3 is a side view of the aerodynamic toy shown in FIG. 1.

Turning now to the drawing there is shown in FIG. 1 thereof an aerodynamic toy 10 in accordance with the invention comprising a rotatable free flight body of circular configuration. As shown in the drawing, aerodynamic toy 10 comprises a geometrically centrally disposed cylindrical shaped hollow first body portion 11 of predetermined length having an outside wall 12, an inside wall 13, a closed end provided by flat surface 14, and a lower end 15, open as indicated more clearly in FIG. 4. As indicated in FIG. 3 of the drawing, the cylindrical shaped first body portion 11 forms a curve 16 where joined with flat surface 14 around its periphery.

A second body portion 17, concentric with the first body portion 11, having a generally convex side 18 and a concave side 19, and being integral with first body portion 11, extends outwardly from it at its open end, as indicated, and is defined by a rim portion 20. Rim portion 20 is integral with and forms a smooth curve, as indicated, with body portion 17 and is in a shape approximating a parabola that opens inwardly toward the center of the aerodynamic toy.

A plurality of elevations 21 are provided integral with body portion 17 and extend radially outwardly from body portion 11 of the aerodynamic toy. As indicated, elevations 21 are flat surfaced on top and the inner ends 22 of the elevations are integral with cylindrical body portion 11 and provide discontinuities 23 in its wall structure at open end 15. However, as will be appreciated, the top surface of these elevations may be slightly curved from one side thereof to the other. Elevations 21, while being straight overall, are seen to taper from their inner ends, to a more narrow width at their outer extremities 24 adjacent rim portion 20. These elevations, as will be appreciated, provide discontinuities on the convex surface 18 of the aerodynamic toy 10, and during flight, create a turbulent, believed unseparated, boundary layer of air over this surface thereby reducing aerodynamic drag and providing increased lift. As indicated in the drawing (see FIG. 3), the flat top surfaces of the elevations extend outwardly in a horizontal plane toward rim portion 20, and parallel to an imaginary plane formed by the bottom edge of rim portion 20. Thus the distance of the top surface of an elevation from convex surface 18 is slightly greater at the rim portion e.g., about 3/32 inch, than nearer body portion 11, e.g., about ⅛ inch.

Figure 4:
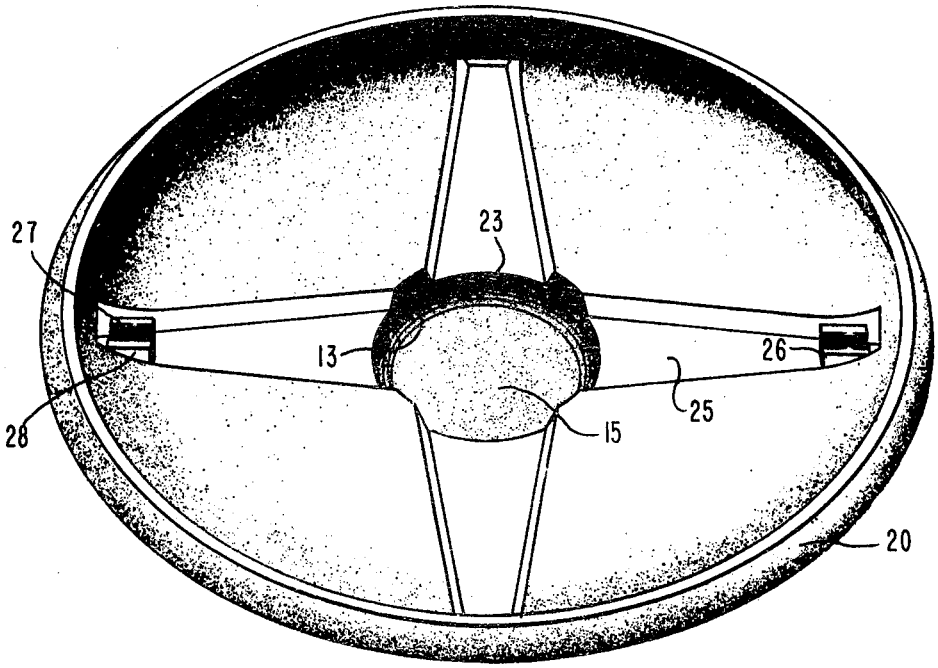
FIG. 4 is a view in perspective of the underneath side of the aerodynamic toy shown in FIG. 3.

As shown in FIG. 4 of the drawing elevations 21 result in indentations 25 on the concave side 19 of aerodynamic toy 10 in outline of each respective elevation 21 on the convex side 18. Clips 26, which basically comprise flexible walls 27, 28, which angle slightly toward one to provide gripping means, are provided in indentations 25 for a reason that will be later more fully explained. These clips can be provided integral with indentations 25 during the manufacture of aerodynamic toy 10 or be separately applied to the toy subsequent to manufacture. In this case, clips such as desired are available commercially, and comprise a base from which depend toward one another two flexible wall members between which a wire or the like member can be inserted for retention.

Figure 5:
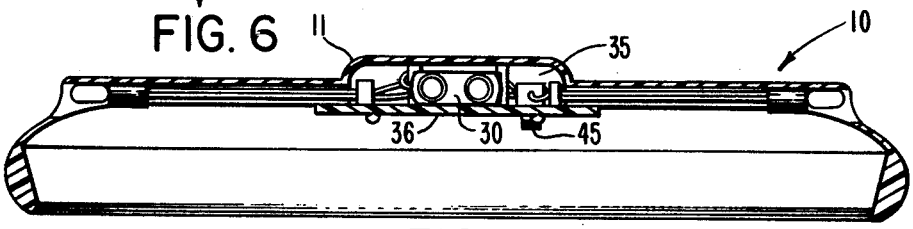
FIG. 5 is a view in cross section of the preferred embodiment of the invention taken at secant lines 5—5 in FIG. 1 and showing lighting means in combination with the aerodynamic toy.

In FIG. 5, there is disclosed a further and optional embodiment of an aerodynamic toy 10 in accordance with the invention including in combination therewith a lighting means 29. Lighting means 29 comprises appropriate electrical circuitry such as a dry cell battery 30, wiring harness 31 including battery clip 32 and lights 33. Wiring harness 31 is provided with a switch means, indicated diagramatically by reference numeral 34, so that the lights 33 can be turned on and off, as desired.

As will be appreciated, by reference to FIG. 5, battery 30 and a part of wiring harness 31 is retained in the well or receptacle 35 provided by the hollow interior of cylindrical body portion 11. The cylindrical body portion, as shown, is preferably just of sufficient depth to accommodate battery 30; however, it can be made somewhat deeper, if desired. Battery 30 is detachably mounted on closure 36 between spaced apart walls 37, 38, these walls being provided at their free ends with inwardly directed flanges 39, 40. Walls 37, 38 can be provided integral with closure 36 during manufacture, or if desired, attached by its bottom member 41 to closure 36 by suitable adhesive or other means.

Walls 37, 38 should be spaced apart sufficiently to accomodate battery 30; however, they should be close enough together to provide a sufficiently tight fit to thereby prevent movement of the battery during use of the aerodynamic toy 10. Movement away from closure 36 is, as will be appreciated, prevented by flanges 39, 40.

Figure 6:
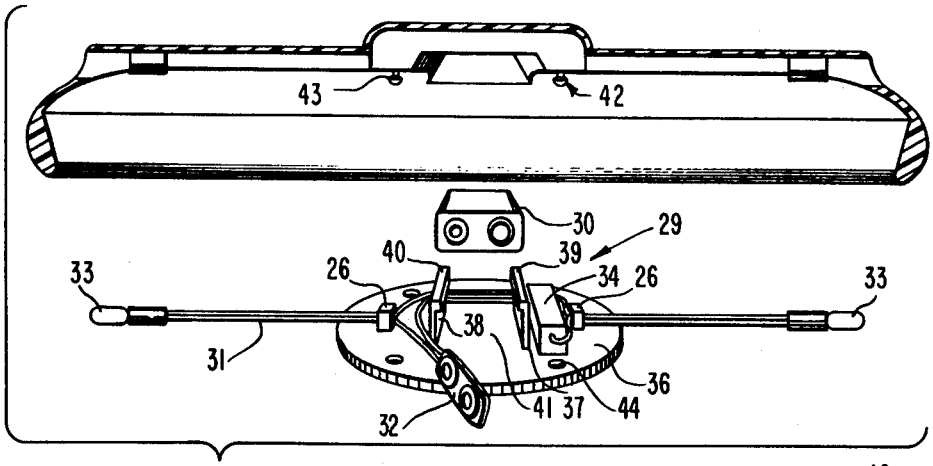
FIG. 6 is an exploded view of the aerodynamic toy shown in FIG. 5 showing the dry cell battery and wiring harness mounted on a retaining means for the battery.

Closure 36 is, as is shown in FIG. 6 of the drawing, of circular configuration; however, it need not not necessarily be circular. The primary concern is to provide a means for mounting battery 30 and wiring harness 31 so that the battery can be fitted into receptacle 35. However, it is desirable that a circular shaped closure be provided as end 15 is of this shape and is thus readily closed. Closure 36 is preferably of slightly larger diameter than cylindrical body portion 11 so that it can be readily detachably connected to concave side 19. This can be accomplished by various means, as will be appreciated; however, one such means of accomplishing detachable connection is to provide snap type fasteners, as is conventionally done to fasten two members together temporarily. Thus, there is provided on concave side 19 of aerodynamic toy 10 a plurality, in this case four, of outwardly protruding members 42, enlarged at their ends 43, to be snapped into circular shaped openings 44, located correspondingly in closure 36.

When desired to have a lighted aerodynamic toy 10, dry cell battery 30, such as any conventional 9-volt battery, is attached to appropriate electrical circuitry 31 such as above-described, and the battery 30 is then inserted into the mounting means on closure 36. Wiring harness 31 is then clipped, as shown, into clips 26 provided on closure 36, and closure 36 is snapped onto the aerodynamic toy 10. The ends of the wiring harness 31, to which the lights 33 are attached, are then clipped to clips 26 in indentations 25. Thus, when switch 34 is activated by means of slide (on-off) button 45 to make and break the circuit to turn on the lights 33, light will emit from the open ends of elevation 21, as shown in FIG. 5. Elevations 21 need not be open; and if desired, can be provided with clear windows of plastic or the like. Elevations that are not to be provided with lights, can be closed, if desired. As disclosed in the drawing particularly FIG. 5, the ends of elevations 21 are located about ½ inch or so back from the edge of the aerodynamic toy so as to allow the light given off by lights 33 to be more readily visible and also to provide a circular motion light.

Although light in the drawing is shown to emit from the ends of only two elevations 21, it will be understood that a wiring harness 31 can be provided to provide additional lights, as desired. When additional lights are provided, however, it is necessary to keep in mind that their number and location should be such as to maintain balance and stability during flight of the aerodynamic toy 10. In connection with this, battery 31 should, of course, be mounted on closure 36 so as to provide balanced flight.

While in the practice of the invention, conventional nine-volt batteries have been found satisfactory in performance and are preferred, other batteries can be used, if desired. Similarly, it is possible to use various lighting means; however, satisfactory light is provided, and for relatively long periods of time, by means of conventional light emitting diodes (LED). The lights can be white or colored, as desired, and wired in parallel or series, series wiring being preferred. As shown in the drawing, and as above disclosed, wiring harness 31 is retained in its desired position on concave side 19 by means of a plurality of clips 26; however, other means can be provided to accomplish this purpose, if desired. One such means is to provide grooves integral with the concave surface 19 of just sufficient width and depth to firmly accomodate the wiring and prevent its dislodgement during flight.

Figure 7:
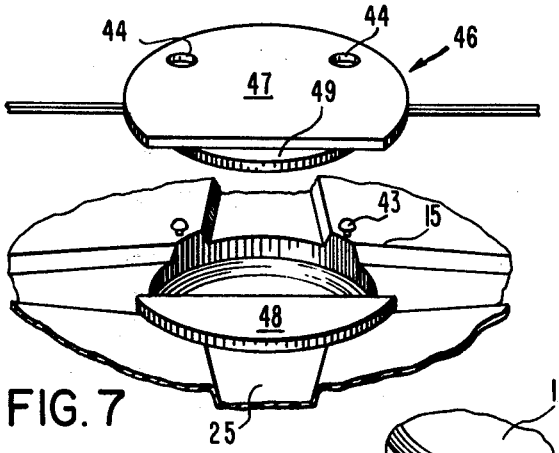
FIG. 7 is another embodiment of a retaining means or cover for the battery chamber.

Various other means can be provided for retaining and supporting battery 30 in receptacle 35. One such means is disclosed in FIG. 7 and comprises a closure 46. As shown, closure 46 comprises a segment 47 of a circle of somewhat larger diameter than open end 15 of cylindric body portion 11, that mates with and complements circular segment 48. Circular segment 48 can be provided integral with aerodynamic toy 10 during its manufacture or separately attached thereto subsequently by means of adhesive or other suitable means. Circular segment 48, as is shown, is provided in location bridging an indentation 25 whereby, as will be appreciated, an opening is provided for receipt of locking means 49. Locking means 49 can take various forms, however, a circular segment of a circle having the diameter of the inside diameter of cylindrical body portion 11 will be found satisfactory. Segment 49 can be adhesively secured to circular segment 47 or manufactured integral therewith, as desired.

Wiring harness 31 and battery 30 can be mounted on closure 46 in a manner similar to that disclosed earlier in connection with closure 36. However, the battery can be, if desired, detachably mounted to the underneath surface of end closure 14. This can be done by elastic or other means provided, attached, integral or otherwise, to the underneath surface. Such a mounting places none of the battery weight on the closure for the cylindrical body portion, and may be desirable in certain instances.

In further embodiments of the invention, a greater or lesser number of radial elevations 21 can be provided, as desired, so long as they are located to provide a balanced aerodynamic toy. Thus, three elevations 21 can be provided, located 120 degrees apart from one another. Where lighting means is used in such an aerodynamic toy, lights will be provided for each elevation so as to provide a balanced structure.

Figure 8:
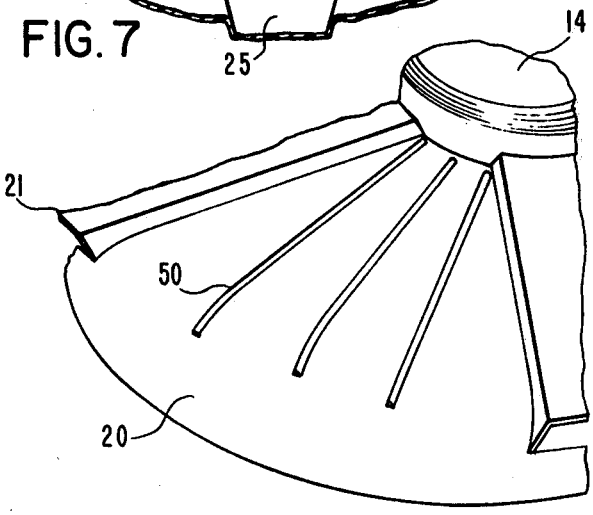
FIG. 8 is another embodiment of the aerodynamic toy in accordance with the invention showing other elevation means.

While radial elevations of the configuration as shown in FIGS. 1–5 are most preferred for best performance, the elevations need not have this particular configuration. Other elevations of different configuration will be found satisfactory so long as they are radially extending. One variation that will be found suitable is designated by reference numeral 50 in FIG. 8. As indicated, the radial elevations on the aerodynamic toy can be all of the same configuration or a combination of elevations 21 and 50, as shown, can be provided. However, elevations as shown in FIGS. 1–5 are preferred.

Aerodynamic toy 10 can be readily manufactured by conventional molding means, e.g., injection molding, and from various plastic materials such as polyvinylchloride, polyethylene, polypropylene, and the like. The plastic compositions can incorporate various of the conventional compounding agents to alter the physical properties of the plastic material, as desired, e.g., density, flexibility, hardness, etc. Coloring agents can be included to provide any suitable color, or combination thereof.

It is of course desirable that the aerodynamic toy be of relatively light weight; however, not so light as to adversely effect its performance. The optimum weight for any particular aerodynamic toy will depend somewhat on its particular size, i.e. diameter, and construction e.g. number and configuration of elevations. In general, however, a weight of about 1.8 grams/inches$^3$ volume displacement will be found satisfactory for an aerodynamic toy as shown in FIG. 5, and having a diameter of about 10.5 inches.

Such a toy will be found to perform satisfactory even when carrying a battery, etc. weighing about 40 grams. Manufacture of the toy is to be accomplished so that the thickness of the plastic material comprising the body portion is uniform throughout, e.g. about 1/16th inch, except that the rim portion as shown should be somewhat thicker, e.g. about 5/64th inches, to provide greater weight around the rim. As earlier disclosed, rim portion 20 approximates that of a parabola opening toward the center of the aerodynamic toy. Where the concave side of the rim portion is made more parabolic than shown in FIG. 5, somewhat greater buoyancy and flotation will be provided during flight, and this may be desirable in certain instances.

In use, the aerodynamic toy 10 is gripped by placing the thumb on the convex side of the toy and one or more of the fingers of the hand on the concave side. The toy is then thrown into the air with a twist of the wrist to give the aerodynamic toy a spinning impetus thereby causing it to rotate about its geometric center and to translate generally in the direction in which it is thrown.

The radial extending elevations provided in accordance with the invention serve to provide improved lift in the aerodynamic toy whereby it provides good free flight performance and sufficient lift to support a lighting system in the event that such is desired.

As many different embodiments of this invention will now occur to those skilled in the art, it is to be understood that the specific embodiment of the invention as presented herein is intended by way of illustration only and not limiting on the invention, but that the limitations thereon should be determined only from the appended claim.

What I claim is:

1. An aerodynamic toy comprising a rotatable free flight body of generally circular configuration and having a convex upper surface and a concave bottom surface comprising a geometrically centrally disposed cylindrical shaped first body portion of predetermined uniform length having an upper end and a lower end, a flat surface integral with and enclosing the cylindrical body portion at its upper end, a second body portion concentric with said first body portion having an upper convex side and a lower concave side, said second body portion being integral with and extending outwardly from the cylindrical body portion at its open end, a rim portion integral with and defining the circumferential perimeter of the second body portion, said rim portion having the shape of a parabola forming a smooth curve with and being an extension of the second body portion and opening toward the center of the aerodynamic toy, and a plurality of elevations extending rectilinearly along said upper convex side and radially outwardly from the said first body portion to points adjacent said rim and being integral with said second body portion.

2. An aerodynamic toy according to claim 1 wherein the said radial elevations are disposed equidistant angularly around the geometric center of the aerodynamic toy.

3. An aerodynamic toy according to claim 2 wherein the radial elevations are of greater width nearer the geometric center of the toy than nearer the rim portion.

4. An aerodynamic toy according to claim 3 wherein there are four radial elevations and said elevations are spaced 90 degrees from one another.

5. An aerodynamic toy according to claim 1 wherein lighting means are provided in combination with the aerodynamic toy 6. An aerodynamic toy according to claim 5 wherein said lighting means comprises at least one dry cell battery and a wiring harness including switch means and lighting means and said cylindrical body portion comprises retaining means for the said at least one battery.

7. An aerodynamic toy according to claim 6 wherein said retaining means comprises a circular shaped closure for the said lower end of the cylindrical body portion.

8. An aerodynamic toy according to claim 7 wherein a holder for the battery is provided on said closure to prevent movement of the battery during use of the aerodynamic toy.

9. An aerodynamic toy according to claim 1 wherein a first means is provided integral with the concave side of the aerodynamic toy for partially closing off the free end of the said cylinder body.

10. An aerodynamic toy according to claim 9 wherein a second means is provided for interlocking engagement with said first means for supporting a battery and closing off the free end of the open end of the cylindrical body portion.

11. An aerodynamic toy according to claim 10 wherein the first means is a first section of a circular shaped cover of predetermined diameter larger than the diameter of the cylindrical shaped body portion and the second means is a second and complementary section of the circular shaped cover.

12. An aerodynamic toy according to claim 11 wherein means are provided on the concave side of the second body portion for fastening the cover means thereto.

13. An aerodynamic toy according to claim 12 wherein the means for fastening are snap type fasteners.

14. An aerodynamic toy according to claim 13 wherein lighting means are provided in combination with the aerodynamic toy and said lighting means are located adjacent the outer ends of the radial elevations.

* * * * *